US005984629A

United States Patent [19]

Brodersen et al.

[11] Patent Number: 5,984,629

[45] **Date of Patent: *Nov. 16, 1999**

[54] TURBO-MACHINE WITH REDUCED ABRASIVE WEAR

[75] Inventors: Sonke Brodersen, Schriesheim; Peter Hergt, Ludwigshafen, both of Germany

[73] Assignee: KSB Aktiengesellscaft, Frankenthal, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,102

[22] Filed: Mar. 25, 1996

Related U.S. Application Data

[63] Continuation of application No. PCT/EP94/03108, Sep. 16, 1994.

[30] Foreign Application Priority Data

Sep. 25, 1993 [DE] Germany ..... 43 32 703
Sep. 8, 1994 [DE] Germany ..... 44 31 947

[51] Int. Cl.[6] ..... F04D 29/16

[52] U.S. Cl. ..... 415/172.1; 415/173.1

[58] Field of Search ..... 415/121.2, 172.1, 415/173.1

[56] References Cited

U.S. PATENT DOCUMENTS

| | | | |
|---|---|---|---|
| 1,634,317 | 7/1927 | Benson . | |
| 2,066,505 | 1/1937 | Wolfe | 415/121.2 |
| 2,644,403 | 7/1953 | Dawson . | |
| 3,447,475 | 6/1969 | Blum . | |
| 3,535,051 | 10/1970 | Turner . | |
| 3,881,840 | 5/1975 | Bunjes | 415/121.2 |
| 4,023,918 | 5/1977 | Stahl | 415/170.1 |
| 4,349,322 | 9/1982 | Stahle | 415/121.2 |
| 5,106,262 | 4/1992 | Oklejas et al. | 415/172.1 |
| 5,171,126 | 12/1992 | Becker et al. | 415/121.2 |
| 5,209,635 | 5/1993 | Stewart et al. | 415/171.1 |

FOREIGN PATENT DOCUMENTS

| | | | |
|---|---|---|---|
| 2 88 500 B1 | 10/1987 | European Pat. Off. . | |
| 3 46 677 B1 | 5/1989 | European Pat. Off. . | |
| 5 38 212 A1 | 7/1992 | European Pat. Off. . | |
| OS 3 90 366 | 2/1924 | Germany . | |
| PS 8 32 549 | 2/1952 | Germany . | |
| GM 72 12 098 | 11/1972 | Germany . | |
| 22 10 556 | 9/1973 | Germany . | |
| OS 23 22 772 | 11/1973 | Germany . | |
| 23 44 576 A1 | 3/1975 | Germany . | |
| 29 03 064 B2 | 8/1979 | Germany . | |
| 35 19 874 | 1/1986 | Germany . | |
| 35 19 874 A1 | 1/1986 | Germany . | |
| 38 08 598 A1 | 9/1989 | Germany . | |
| 91 11 660 | 11/1991 | Germany . | |
| 0103907 | 8/1979 | Japan | 415/172.1 |
| 57 153 999 | 9/1982 | Japan . | |
| 6074138 | 3/1994 | Japan | 415/172.1 |
| 0775394 | 10/1980 | Russian Federation | 415/121.2 |
| 1262128 | 10/1986 | Russian Federation | 415/173.1 |
| 63 412 | 1/1913 | Switzerland . | |
| 499726 | 11/1970 | Switzerland . | |
| 4 99 726 | 1/1971 | Switzerland . | |
| 1 003 980 | 9/1961 | United Kingdom . | |
| 88 02820 | 4/1988 | WIPO . | |

OTHER PUBLICATIONS

DE–AN Sch 2972—Dec. 7, 1951 (5 Sheets).

Patent Abstracts of Japan, vol. 6, No. 260 (M–180) Dec. 18, 1982.

*Primary Examiner*—John T. Kwon
*Attorney, Agent, or Firm*—Darby & Darby

[57] ABSTRACT

A turbo-machine for transporting media loaded with solid particles includes a housing. At least one impeller is disposed inside the housing and defines impeller side spaces disposed between the impeller and the housing. Wall surfaces bound the impeller side spaces. The wall surfaces have various shaped protrusions, recesses, blades and grooves for conducting the flow of the medium near the wall at least partly into regions where the transport medium has a greater rotational motion.

11 Claims, 10 Drawing Sheets

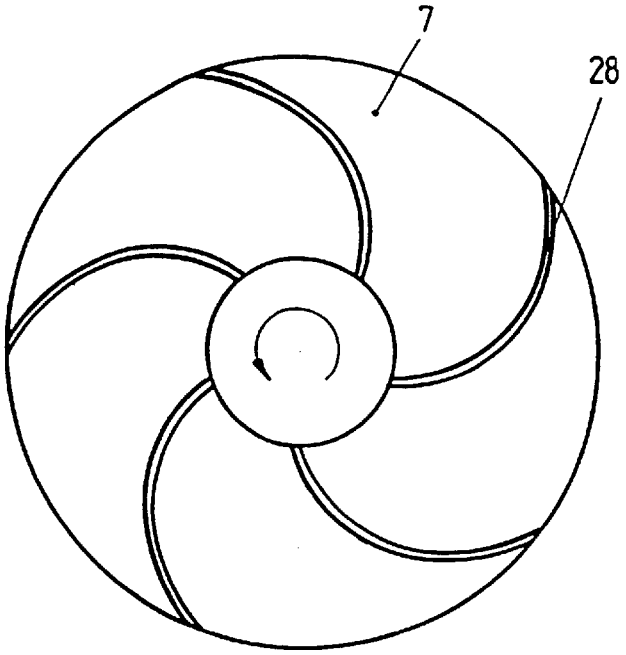
FIG. 21
FIG. 22
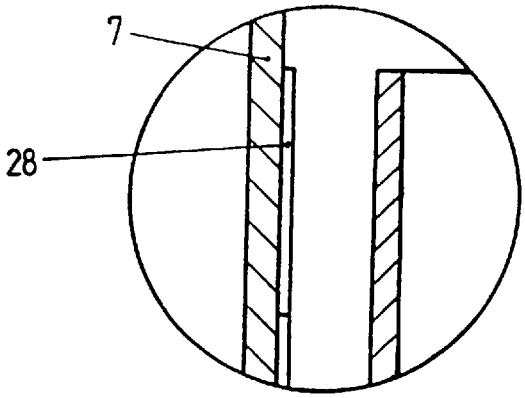
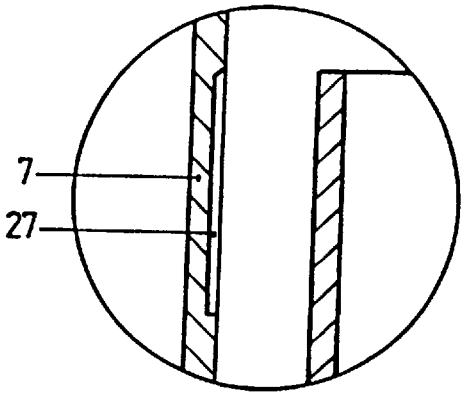
FIG. 23

TURBO-MACHINE WITH REDUCED ABRASIVE WEAR

This application is a continuation of PCT/EP94/03108 filed Sep. 16, 1994.

BACKGROUND OF THE INVENTION

1. Field of the Invention

The present invention relates to a turbo-machine for transporting media charged with solid particles, with one or more impellers disposed inside a housing.

2. Discussion of the Related Art

Turbo-machines can include pumps, turbines, pump-turbines, or the like. They are used in the most various fields of engineering. For a long time, designers have tried to improve the lifetime of these machines which are exposed to wear from abrasive particles.

The first measures for this are generally to use a specially hard and wear-resistant material. For example, in the case of centrifugal pumps, the wheel side spaces and the glands located in these have proven to be areas that are especially sensitive to wear. If the gaps of the glands are enlarged due to wear of the material, increased hydraulic losses will result and, as a consequence of this, reduced efficiency. Furthermore, in the case of multi-stage machines, strong oscillations will result, which can cause the entire unit to break down.

From the European reference EP-B-0 346 677, a way is known to protect the space which receives a shaft seal and a shaft seal itself against wear. This space is located behind the impeller and is separated by a diaphragm gland from the wheel side space, which actually has a higher pressure.

From the German reference DE-A-22 10 556, a centrifugal pump is known in which especially wear-resistant parts, such as the spiral space and the abrasion plates which bound the impeller side space are supposed to improve the lifetime of the machine. Furthermore, by feeding particle-free material into this machine, the wheel side space and also the gland can be protected against abrasive particles.

German reference DE-A-23 44 576 discloses another measure, its design being such that additional transport channels are present in the area of the diaphragm glands. The entries to these transport channels are preceded by a surrounding annular chamber. This measure is supposed to free the transport medium entering the diaphragm gland from abrasive particles. The particles are separated out in the annular chamber, are transported through the transport channels into the wheel side space, and the water liberated thereby then flows to the actual diaphragm gland quasi-free of particles. This measure may indeed be somewhat successful initially, but after a short operating time, the transport channel will become increasingly ineffective. The reason for this is that the particles will become more concentrated in the area of the gland entry, in combination with the after-flowing medium, and wear will thus be accelerated.

Another measure is known from European reference EP-B-O 288 500, where auxiliary blades are affixed on the outside of impeller cover disks. However, annular webs are interspersed among these auxiliary blades so as to reduce the flow of liquid in the impeller side space. But practical tests have shown that this solution also cannot prevent wear.

German reference DE-A-38 08 598 tries to increase lifetime by means of a certain inclination of the surrounding wall surface of the space following an impeller.

SUMMARY OF THE INVENTION

The present invention is based on the problem of reducing or eliminating the wear problems described above, in principle eliminating their cause. The solution of this problem is such that the wall surfaces bounding the impeller side spaces, between the impeller exit and the diaphragm gland, have shapes which guide the flow of medium near the wall into ranges of higher rotational motion. It was recognized that the abrasive particles always migrate radially inward in the vicinity of the stationary, i.e. non-rotating, wall surfaces. The radially outward transport effect resulting from the impeller side friction is increased still more by outer auxiliary blades in the case of known impellers, and consequently particulate medium flows radially inward along the stationary wall surfaces and toward the glands to the same extent. Accordingly, the inventive solution is intended to prevent the radially inward transport of particles in the region of the stationary boundary walls and, if this is not possible completely, to put the particles near the wall or the stream charged with such particles near the wall into a region of higher rotational motion of the transport medium. From this region, the particles can then easily be transported outward, away from the endangered wall surfaces. Depending on the performance data of the turbo-machine, the designs relative to the impeller outer radius can be arranged at different radii, i.e. for the radii best suited for the particular purpose. This can be disposed e.g. in the region of an impeller exit, directly in front of a diaphragm gland or a shaft seal in the region in between, but also in an impeller side space between the shaft and the diaphragm gland. The sub-claims of the invention describe further developments of the invention which will be explained in more detail in connection with the descriptions of the individual figures.

BRIEF DESCRIPTION OF THE DRAWINGS

The above and still further objects, features and advantages of the present invention will become apparent upon consideration of the following detailed description of a specific embodiment thereof, especially taken in conjunction with the accompanying drawings wherein:

FIGS. 3 through 25 show details of various shapes between a stationary and a rotating wall surface.

DETAILED DESCRIPTION OF THE PREFERRED EMBODIMENTS

Figure 1:
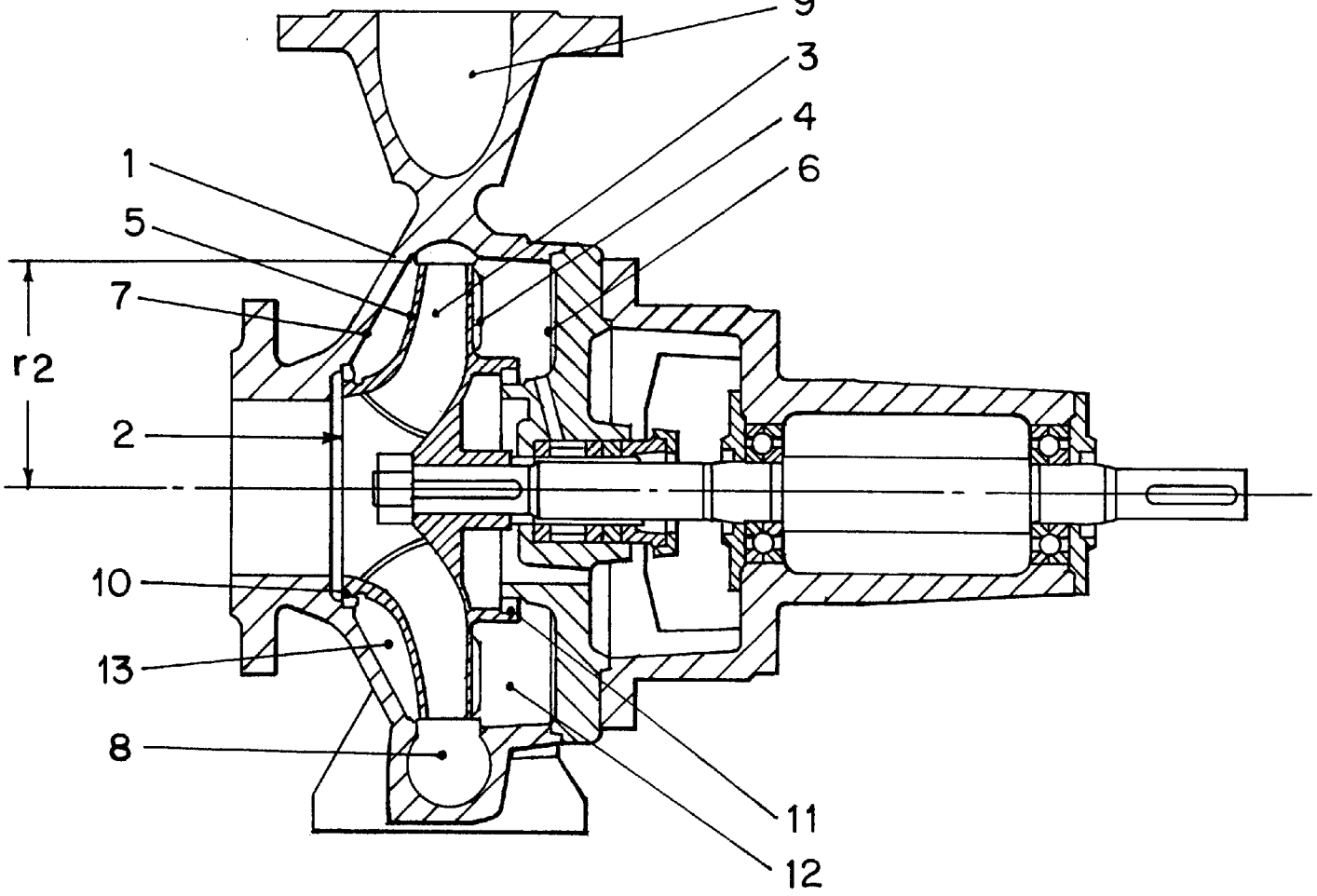
FIG. 1 shows, as an example of a turbo-machine, a singe-stage centrifugal pump with a spiral housing, in section.

In FIG. 1, an impeller 2 with an outer radius $r_2$ is disposed inside a housing 1. The blades 3 of this impeller are disposed between an impeller cover disk 4 on the pressure side and an impeller cover disk 5 on the suction side. Stationary surfaces of the housing wall, namely, a housing wall surface 6 on the pressure side and a housing wall surface 7 on the suction side, are situated opposite these cover disks 4, 5, respectively. The impeller 2 is surrounded by a spiral space 8, which is connected to a pressure joint 9. Due to the pressure drop inside the impeller side spaces, a portion of the medium situated inside the housing 1 flows to the diaphragm gland 10 in the region of the impeller entry and to the diaphragm gland 11 on the pressure side, in the region of a shaft seal. The impeller side friction at the impeller cover disks 4, 5 in familiar fashion creates a flow in the impeller side space 12 on the pressure side and in the impeller side space 13 on the suction side.

The flow condition in the various spaces, as explained in terms of the example of the impeller side spaces 12, 13 must be considered in a differentiated fashion. In an impeller side space 13 on the suction side or a corresponding space, there exists a through-flow due to the existing pressure drop. The medium therefore flows from the region of higher pressure to a region of lower pressure, e.g. in the case of a pump from the impeller exit to the impeller entry. This flow is superposed by a flow which results from the impeller side friction between the rotating surface and the medium which wets it. The like applies to an impeller side space 12 on the pressure side or a corresponding space, if it is possible for the medium to flow through there. This could be an axial thrust-relief bore, or any other opening which makes through-flow possible. However, in the case that there is no through-flow in this space, the radially inward flow at a stationary wall will exist nevertheless. The cause of this then is the impeller side friction. Because of this, a flow with a radially outward component exists at the rotating surface. This results in a backflow at the stationary wall surface, that is in a circulation. In all the cases of through-flow or circulation described above, the medium charged with the abrasive particles flows radially inward, following the stationary surfaces.

Figure 2:
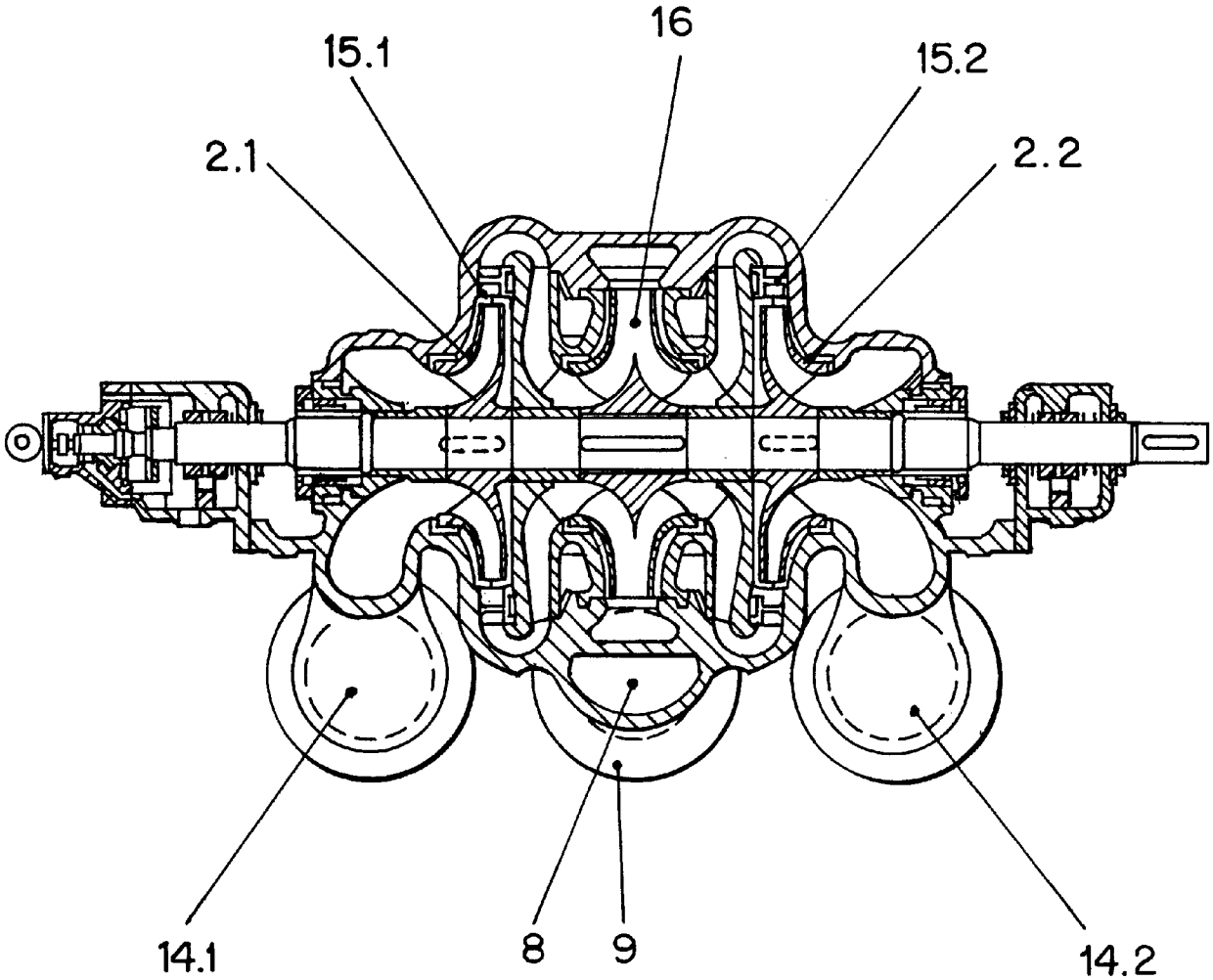
FIG. 2 shows, as an example of a turbo-machine, a multi-stage centrifugal pump with guide wheels following the impellers.

The other embodiment of a multi-stage turbo-machine, shown in FIG. 2, behaves in a corresponding manner. When it is operated as a pump, the medium that is charged with particles would flow through the suction connections 14.1, 14.2 toward the impellers 2.1, 2.2. In contrast to the embodiment of FIG. 1, the impellers 2.1, 2.2 of the first stage have a diaphragm gland on the pressure side only in the region of the shaft penetration between the individual stages.

After the medium leaves the first impellers, it flows through the guide devices 15.1, 15.2, and flows toward a double-flow impeller 16 of a second stage. From there it enters a spiral space 8, from where it flows off through a pressure joint 9. The environment of the impeller, which was described in more detail in connection with the example of FIG. 1, also applies correspondingly to the embodiment of FIG. 2.

With the exception of FIGS. 13, 14, 16, 17, 21, 24 and 25, the representations of FIGS. 3 to 23 are identical in their structure. These are exemplary designs, always between a left wall surface that is disposed stationary and a right wall surface that is disposed rotating. In accordance with FIG. 1, these therefore would be designs which could be used in the region of an impeller side space 13 on the suction side. The rotation axis of the rotating part of the wall surface is always situated underneath the respective picture. Of course, the pictures shown here would apply correspondingly also to the impeller side space 12 on the pressure side, but then the mirror images of these pictures would be seen. For the sake of simplicity, the description is limited to the specification mentioned above.

FIGS. 3 to 8 show a protruding ring 17 affixed to the stationary housing wall 7. Opposite this, with a gap 18, is situated the rotating impeller cover disk 5. The flow with the abrasive particles migrates radially inward along the fixed housing wall 7. The ring 17 that is used here deflects it in the direction toward the impeller and thus toward the rotating impeller cover disk 5. From there, it is conducted off to the outside with the flow that is caused by the impeller side friction.

The width $t_1$ of the ring 17 should be greater than half the width b of the impeller side space, that is $t_1/b \geqq 0.5$. In practical tests, it has proven especially beneficial to dispose the ring 17 on a relative radius $r_1$, which, relative to the outer radius $r_2$ of the impeller or of the impeller cover disk 5, has a ratio $r_1/r_2$ of approximately 0.8. It is demonstrably effective even for other radii $r_1$. As regards the gap S, as a difference between the width b of the impeller side space minus the width $t_1$ of the ring 17, what is required is that it may not be less than 2 mm. This gap in no way has the function of a diaphragm gland; the latter would be destroyed by the through-flowing particles. Because the minimum gap width is 2 mm or greater, increased wear is prevented from occurring inside the gap region. This applies correspondingly also to the representations in the other subsequent figures.

Figure 4:
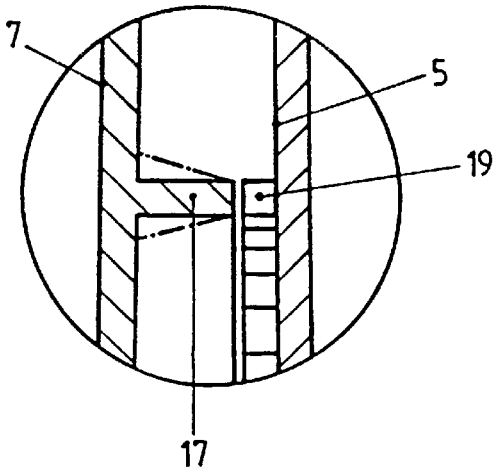

In FIG. 4, several blades 19 are affixed at the rotating impeller cover disk 5, at the same level as the protruding ring 17 and likewise at a small distance thereto. The radial extent of these blades 19 is equal or unequal to the radial extent of the ring. According to FIG. 5, the blades 19 are fastened adjoiningly on the rotating impeller cover disk 5, at a greater diameter and with a greater radial extent.

Figure 3:
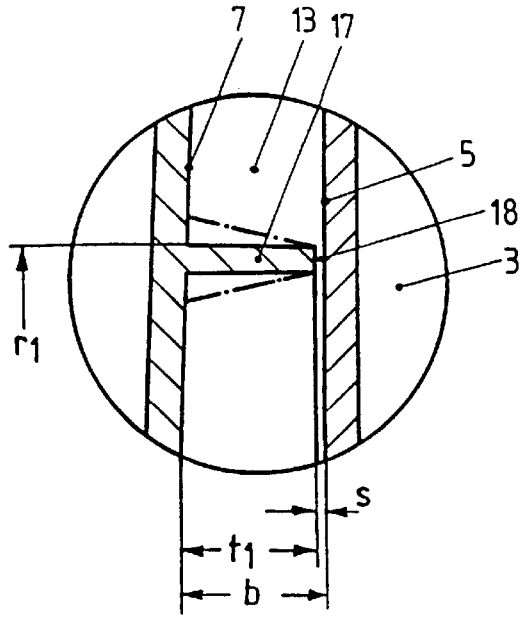
Figure 5:
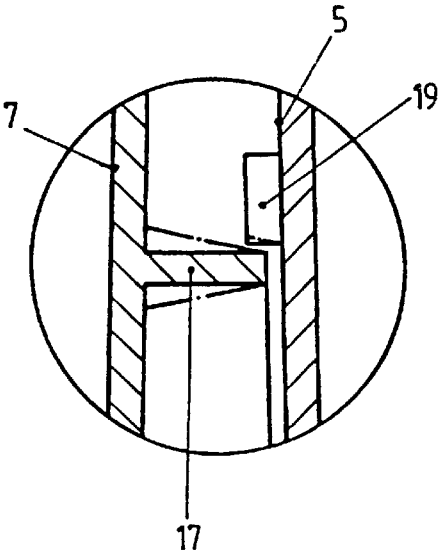

The lines shown by dots and dashes in FIGS. 3 to 5, enclosing the rings 17, symbolize regions in which the ring surfaces are at a different inclination.

Figure 6:
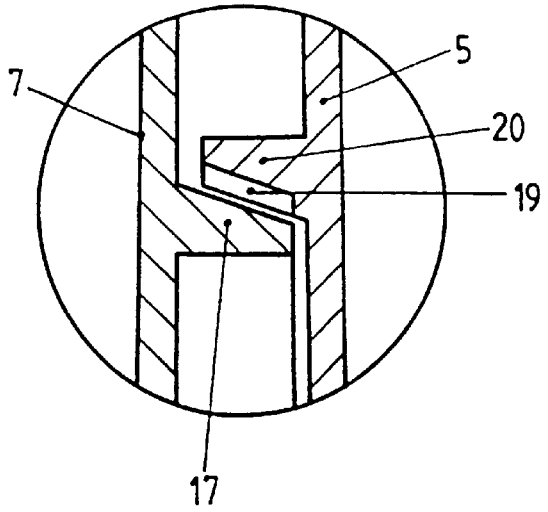
Figure 16:
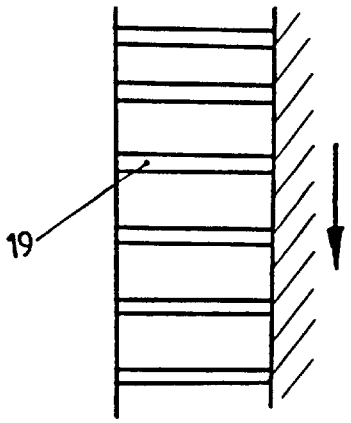
Figure 17:
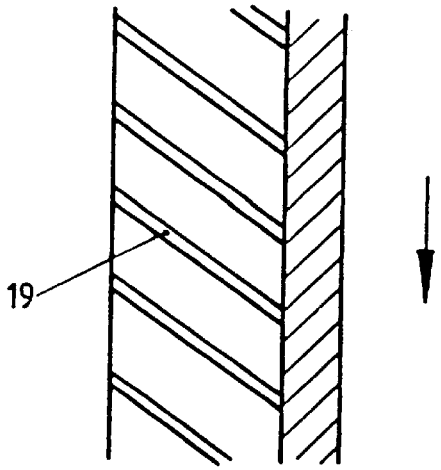

In FIG. 6, a ring 20 is disposed at the rotating cover disk 5. It is situated at a greater diameter than the stationary housing ring 17. The underside of the rotating ring 20, facing the fixed ring 17, is equipped with blades 19, which create a region of higher rotational motion, and consequently deflect the particle-loaded flow near the wall toward the outer diameter of the impeller. In place of the blades 19, grooves which create a transport effect can also be disposed, for example by inserting them into the material of the impeller. When pairing the rings and the blades or the grooves, it is advantages for the gap between the two to be slanted, so as to force the particles to move radially outward. The blades or grooves can be disposed both in the axial direction and perpendicular to the direction of rotation as well as at a certain angle to the axial direction, as is shown in FIGS. 16 and 17 by way of example.

Figure 7:
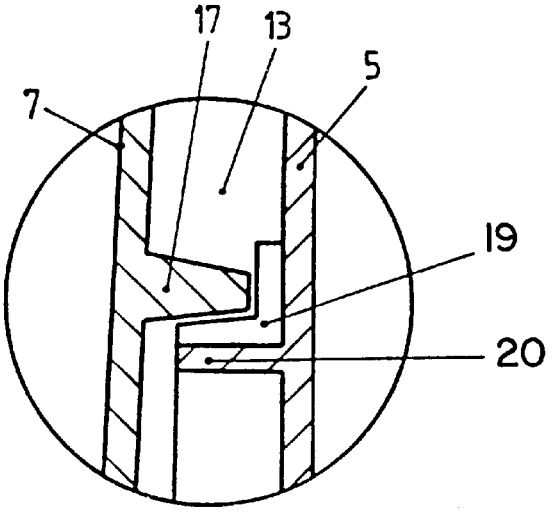

According to FIG. 7, the rotating ring 20 is disposed at a smaller diameter than the stationary ring 17, and has grooves or blades 19 to create a greater rotational motion for the purpose of deflecting the particle-loaded flow near the wall. The grooves or blades 19 are scaled in their conveyance power so that their conveyance power influences the flow near the wall slightly. However, they are so small that they do not reinforce the circular flow within the impeller side space 13, such as is increasingly the case with previously known outer auxiliary blades.

Figure 8:
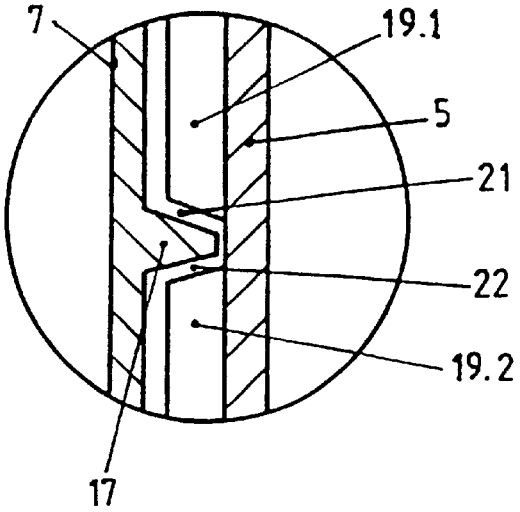
Figure 9:
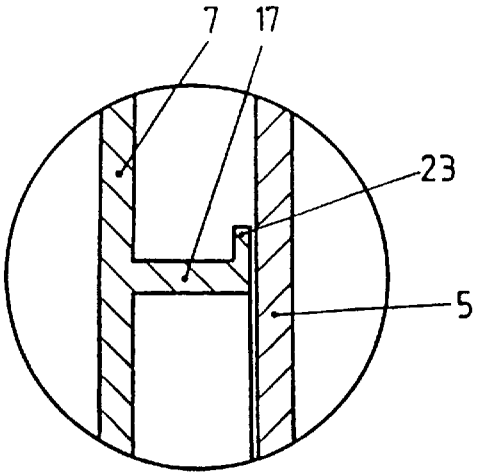
Figure 10:
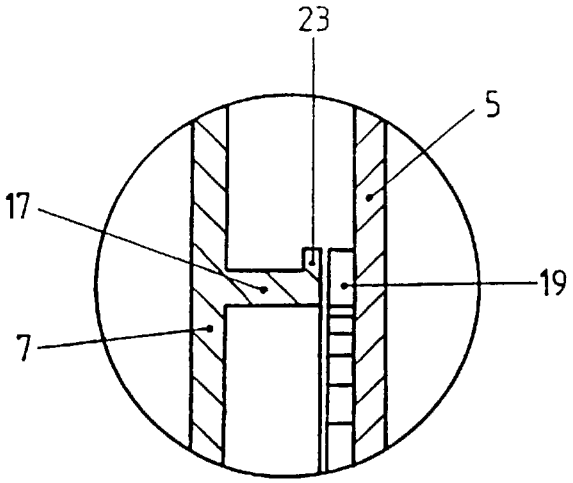

According to FIG. 8, short blades 19.1, 19.2 are disposed at the rotating part 5 of the impeller, above and below the stationary and protruding rings 17. The gaps 21, 22 between the rings 17 and the blades run at a slant.

The blades shown in FIGS. 5 to 8 as well as in the subsequent figures can also be covered wholly or partly by elements shaped like cover disks, in the manner of an enclosed impeller.

In FIGS. 9 to 12, the housing ring 17 has a disk 23 which points radially outward, and which reinforces the deflection of the particle-loaded flow near the wall. Furthermore, the rotating impeller cover disks 5 here may or may not have short blades 19.

The disk 23 can be situated at the ring 17 either on its front side or in its middle region.

Figure 11:
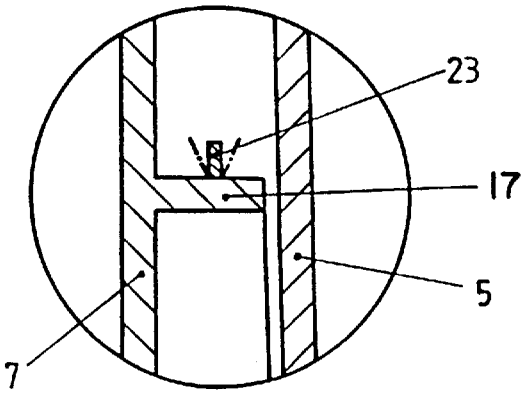
Figure 12:
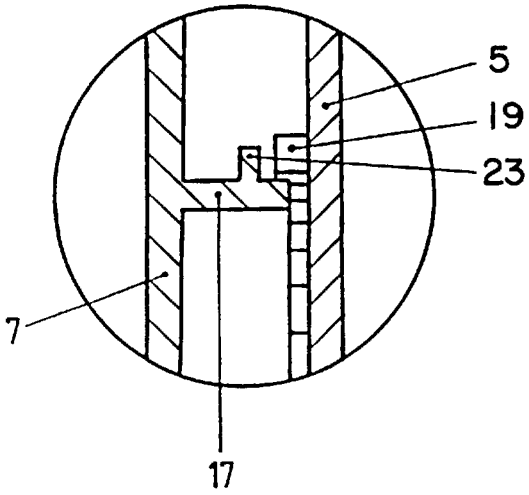

The lines shown by dots and dashes in FIG. 11, which enclose the disk 23 here too symbolize regions where the disk surfaces have different inclinations.

Figure 13:
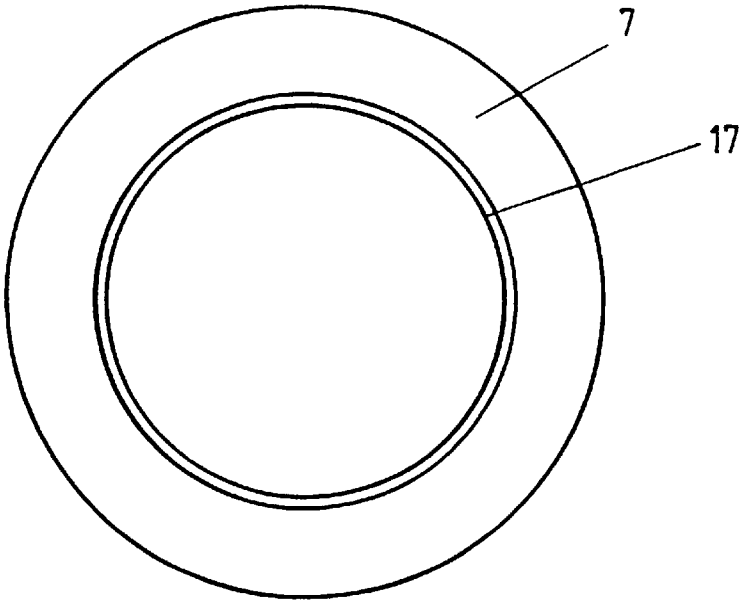
Figure 14:
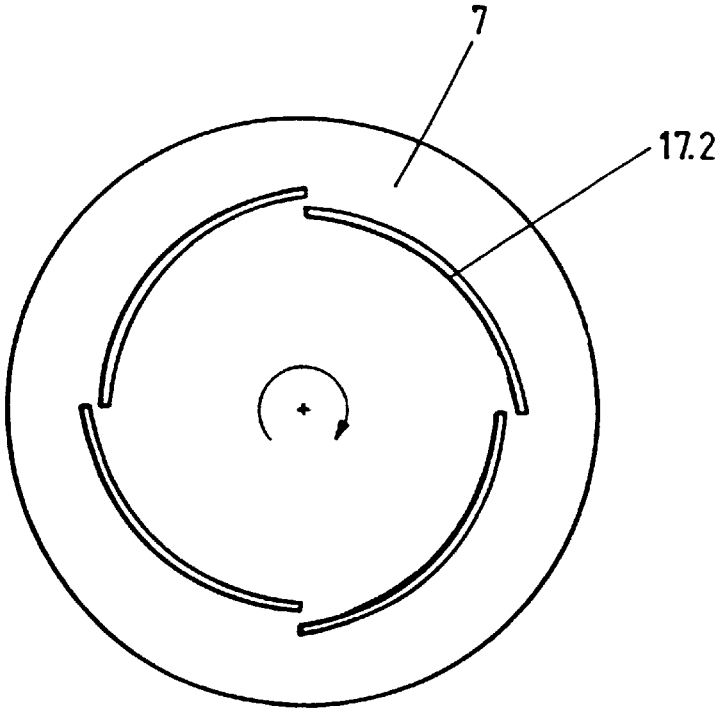

FIGS. 13 and 14 show a top view of the ring 17, which is fixed on the housing. According to FIG. 13, this can be a closed ring, but according to FIG. 14 it can also be a divided ring. The division here can be chosen in such a way that several ring segments 17.2 are arranged in a blade-like pattern relative to the housing wall 7. The center point(s) of the ring segments 17.2 are situated outside the center point of the rotation axis, but displaced in the associated vertical and/or horizontal intersection plane. The individual ring segments here open outward in the sense of rotation of the impeller, which is not shown here. This can achieve a differentiated incidence and thus can affect on the flow. The arrow shows the direction of rotation of the impeller.

Figure 15:
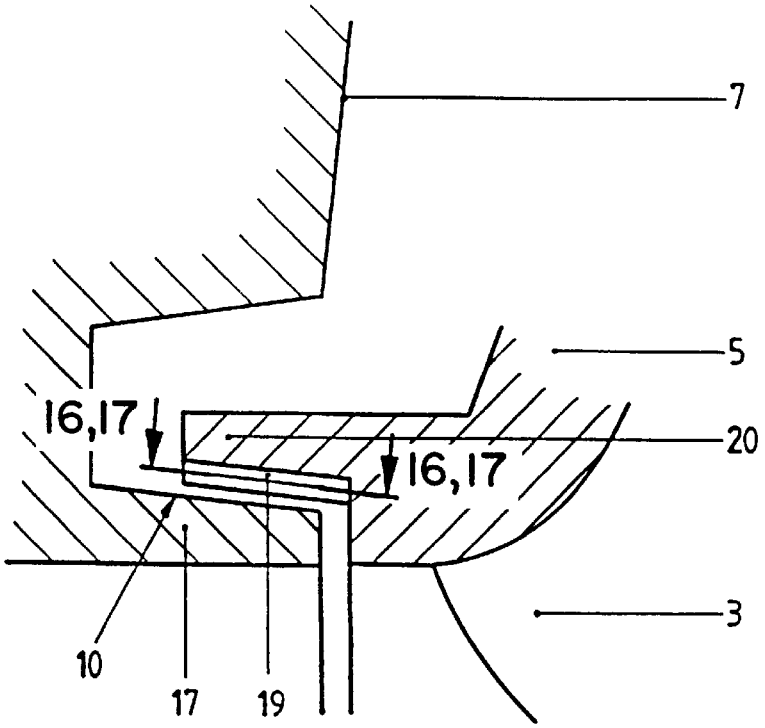

FIG. 15 shows an inventive design, using as an example a diaphragm gland 10 situated on the suction side. A rotating ring 20 has blades 19 on the side which faces the stationary ring 17. Grooves with a similar effect can also be used instead of blades. The rotating part of the diaphragm gland is here situated at a greater diameter than the stationary part, and with a narrow gap being situated in between. The blades 19 or the grooves can be disposed both in the axial direction and perpendicular to the direction of rotation, as well as at a certain angle to the axial direction.

In FIGS. 16, 17, the section line A—A of FIG. 15 shows the developed views of the blades 19 or grooves in the circumferential direction of the impeller. The direction of rotation is here specified by the arrow.

Figure 18:
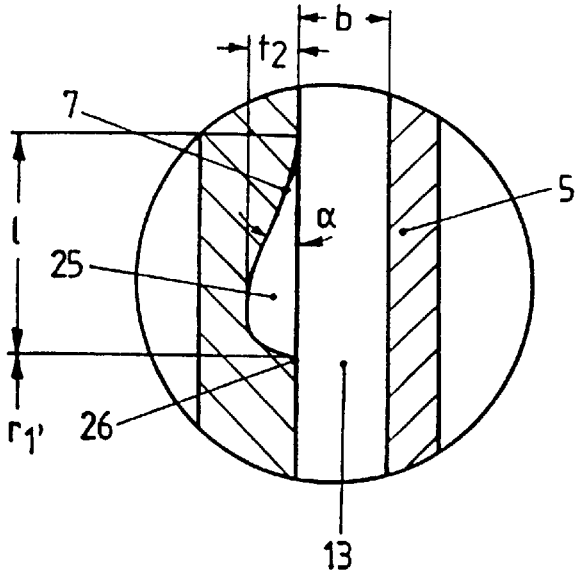
Figure 19:
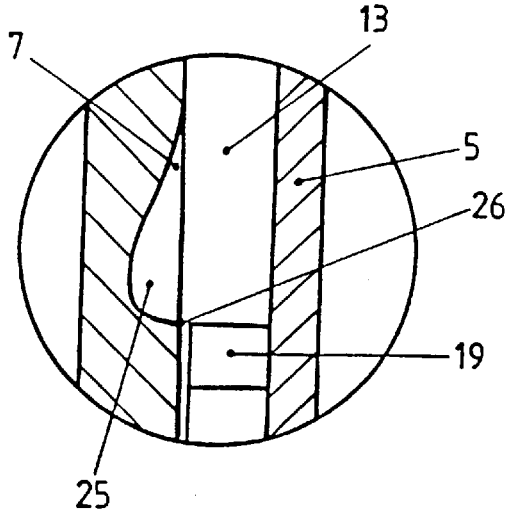
Figure 20:
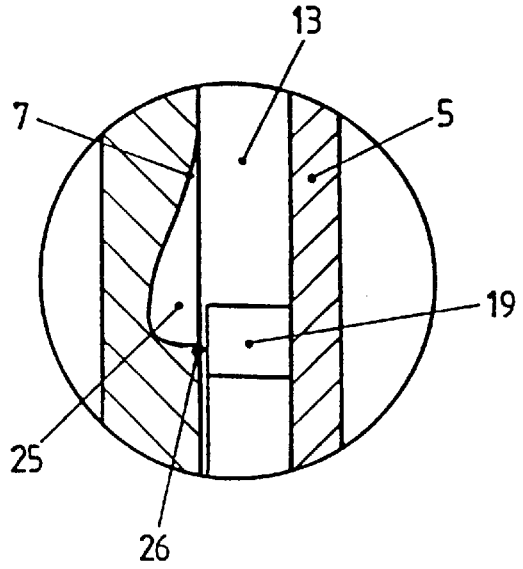

FIGS. 18 to 20 show designs of the wall surfaces, in which, in place of a protruding ring, the wall itself has a type of recess 25, whose run-out, designed as a run-off edge 26, points toward the opposite rotating cover disk 5 of the impeller. Depending on the mode of consideration, this design of the wall surface can also be regarded as a design which constricts the side space 13 or 14 of the impeller. This is then followed by a recess 25 which deflects the particle-loaded flow near the wall. The particle-loaded flow near the wall is deflected along the stationary surface 7 of the housing wall, toward the side space 13 of the impeller, with the greater rotational motion prevailing therein. Here, too, blades 19 with a small radial extent can be affixed to the rotating cover disks 5 of the impeller, so as to enhance the deflection of the particles into a region of higher rotational energy.

The circumstances are specified in more detail in the example of FIG. 18. The angle $\alpha$ specified in FIG. 18 should not exceed 30 deg; the ratio of the length 1 to the depth $t_2$ of the recess 25 is subject to the condition that it should not be less than the value $1/t_2=3$. The depth $t_2$ should be scaled so that it corresponds at least to 3 times the local thickness of the boundary layer. The thickness of the boundary layer is derived from customary calculations (e.g. according to Schlichting; Boundary Layer Theory, G. Braun, Karlsruhe 1982). The boundary layer thickness here depends largely on the medium, the rotational speed of the impeller, on the radius $r_1$ and $r_1'$ and on the width b of the side space 13 of the impeller.

FIGS. 21 to 25 show another way of influencing the flow near the wall. On the one hand, this can be grooves 27 or protruding blades 28 incorporated into a stationary wall surface 7. These grooves or blades progress radially outward in the direction of rotation of the impeller or of the opposite rotating disk surface. Thus they conduct the particles brought in by the flow near the wall, along the radially outward directed contour of the grooves 27 or the blades 28, to the outside. To transport the particle from the interior region of the side space of the impeller to the outside, several cycles inside the impeller side space are needed, until the particles can be discharged inside a spiral or a guide device.

Figure 24:
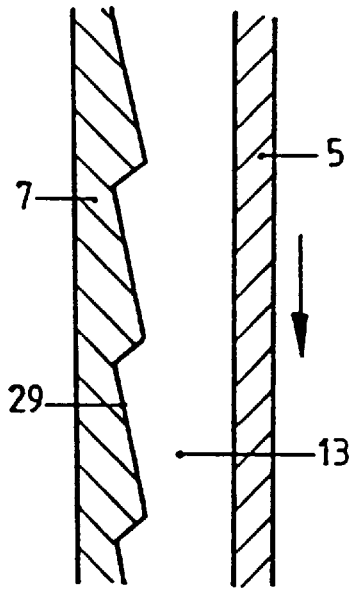
Figure 25:
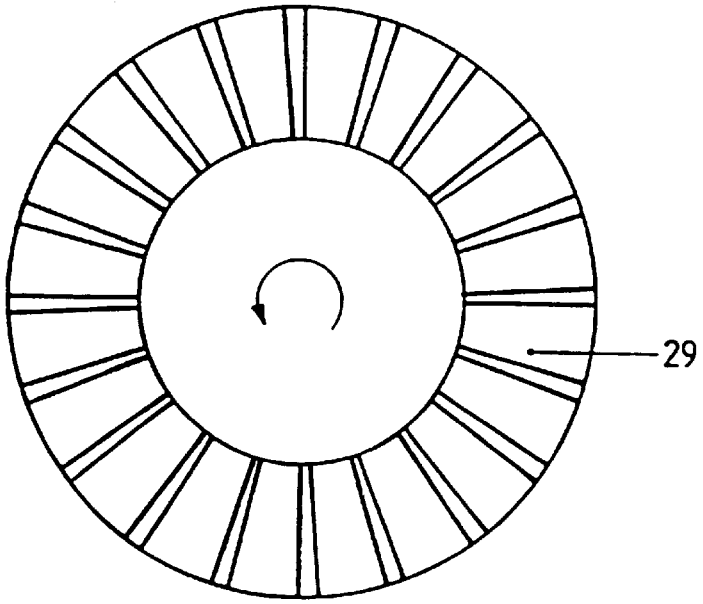

According to FIG. 24, the stationary surface 7 of the housing wall has been designed in saw-tooth shape, such that the flat rise 29 of the contour extends in the direction of rotation of the rotating wall surface 5. By means of this measure, the particles again and again are repelled from the stationary wall, and move into regions where the medium has a higher local rotational speed. Thus, after several cycles, they can again leave the side space 13 or 14 of the impeller. FIG. 25 shows a top view of the wall surface 7 designed in this way.

Having described the presently preferred exemplary embodiments of a turbo-machine in accordance with the present invention, it is believed that other modifications, variations and changes will be suggested to those skilled in the art in view of the teachings set forth herein. It is, therefore, to be understood that all modifications, variations and changes are believed to fall within the scope of the present invention without departing from the spirit and scope of the invention as disclosed above.

What is claimed is:

1. A turbo-machine for transporting media loaded with solid particles, said turbo-machine comprising:

a housing;

a shaft being rotatably mounted within said housing;

at least one impeller disposed inside said housing and fixedly connected to said shaft;

a plurality of impeller side spaces disposed between the impeller and the housing, wherein wall surfaces bound the impeller side spaces, said wall surfaces having means for deflecting a flow of a media near the wall surface that is directed radially inwardly toward said shaft and deflecting the flow away from said shaft in a radially outward direction and at least partly into regions where the transport media has a greater rotational motion.

2. The turbo-machine of claim 1, wherein a portion of the wall surface is stationary, and the conducting means includes a ring protruding in a axial direction and disposed on the stationary wall surface of the housing wall.

3. The turbo-machine of claim 2, wherein a portion of the wall surface is rotatable, and the conducting means includes a plurality of one of blades and grooves attached to the rotatable wall surface opposite an end region of the ring.

4. The turbo-machine of claim 3, wherein the ring interacts with a second ring having at least one of blades and grooves disposed on the rotatable wall surface.

5. The turbo-machine of claim 4, wherein the stationary ring has a protruding disk element extending in a radial direction.

6. The turbo-machine of claim 5, wherein a plurality of one of blades and grooves are disposed on the rotatable wall surface opposite a region of the disk element.

7. The turbo-machine of claim 2, wherein the ring is comprised of a plurality of arc segments, such that a center point of each arc segment is disposed outside a rotation axis of the impeller.

8. The turbo-machine of claim 3, wherein the one of grooves and blades attached to the rotatable wall surface are disposed at an inclined angle relative to a rotation axis.

9. The turbo-machine of claim 1, wherein an annular recess is incorporated into the stationary wall surface, such that a transition between the recess and the stationary wall has a flow-off edge.

10. The turbo-machine of claim 9, wherein at least one of a plurality of blades and grooves are attached to the rotatable wall surface opposite to a flow-off edge.

11. The turbo-machine of claim 1, wherein at least one of a plurality of grooves and blades are attached to the stationary wall surface and extend radially outward in a direction of rotation of an opposite rotatable wall surface.

* * * * *

UNITED STATES PATENT AND TRADEMARK OFFICE

CERTIFICATE OF CORRECTION

PATENT NO. : 5,984,629

DATED : November 16, 1999

INVENTOR(S) : Sonke BRODEREN

It is certified that errors appear in the above-identified patent and that said Letters Patent is hereby corrected as shown below:

Title page, [73] Assignee, please correct "AKTIENGESELLSCAFT"

to --AKTIENGESELLSCHAFT--.

Signed and Sealed this

Twentieth Day of June, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,984,629

DATED : November 16, 1999

INVENTOR(S) : Sonke Brodersen, et al.

It is certified that error appears in the above-identified patent and that said Letters Patent is hereby corrected as shown below:

Column 5, line 23, change "A-A" to --16, 17-16,17--.

Signed and Sealed this

Nineteenth Day of September, 2000

*Attest:*

Q. TODD DICKINSON

*Attesting Officer*

*Director of Patents and Trademarks*